US005273867A

United States Patent [19]

Shibuya et al.

[11] Patent Number: 5,273,867

[45] Date of Patent: Dec. 28, 1993

[54] SILVER HALIDE PHOTOGRAPHIC COLOR LIGHT-SENSITIVE MATERIAL

[75] Inventors: Masahiro Shibuya; Takashi Kadowaki, both of Odawara, Japan

[73] Assignee: Konica Corporation, Tokyo, Japan

[21] Appl. No.: 898,144

[22] Filed: Jun. 15, 1992

[30] Foreign Application Priority Data

Jun. 28, 1991 [JP] Japan ..... 3-158408

[51] Int. Cl.[5] ..... G03C 1/46

[52] U.S. Cl. ..... 430/504; 430/551; 430/372; 430/555; 430/553; 430/557

[58] Field of Search ..... 430/551, 504, 555, 553, 430/557, 370

[56] References Cited

U.S. PATENT DOCUMENTS

| | | | |
|---|---|---|---|
| 4,430,425 | 2/1984 | Leppard | 430/551 |
| 4,517,283 | 5/1985 | Leppard et al. | 430/551 |
| 5,028,515 | 7/1991 | Hasebe et al. | 430/551 |
| 5,041,365 | 8/1991 | Takahashi et al. | 430/551 |
| 5,049,474 | 9/1991 | Ichijima et al. | 430/504 |
| 5,110,718 | 5/1992 | Tanji et al. | 430/555 |
| 5,208,140 | 5/1993 | Nishijima | 430/551 |

FOREIGN PATENT DOCUMENTS

| | | |
|---|---|---|
| 320821 | 6/1989 | European Pat. Off. . |
| 349327 | 1/1990 | European Pat. Off. . |
| 431329 | 6/1991 | European Pat. Off. . |

OTHER PUBLICATIONS

Patent Abstracts of Japan, vol. 13, No. 492, (p. 955) [3840] Nov. 8, 1989, JPA-1-195446; Aug. 7, 1989.

*Primary Examiner*—Charles L. Bowers, Jr.
*Assistant Examiner*—Geraldine Letscher
*Attorney, Agent, or Firm*—Jordan B. Bierman

[57] ABSTRACT

A silver halide color photographic light-sensitive material is disclosed. The light-sensitive material comprises a support having thereon a photographic layer including a silver halide emulsion layer comprising silver halide grains and a binder and a specific pyrazolone type magenta coupler, a non-light-sensitive layer comprising a binder and a compound of Formula II being a liquid at 15° C., and provided adjacently to the surface of said silver halide emulsion layer closer to sais support, and a layer provided at the outermost position of said photographic layer containing a compound represented by Formula II;

(II)

wherein $R_{11}$ and $R_{12}$ are each a secondary or tertiary alkyl group and a number of carbon atoms Contained in the groups represented by $R_{11}$ and $R_{12}$ is 20 or more in total.

8 Claims, No Drawings

SILVER HALIDE PHOTOGRAPHIC COLOR LIGHT-SENSITIVE MATERIAL

FIELD OF THE INVENTION

The present invention relates to a silver halide photographic light-sensitive material, and more particularly to a silver halide photographic light-sensitive material having high image quality and stability on processing fluctuation.

BACKGROUND OF THE INVENTION

Generally, a silver halide color photographic light-sensitive material is processed through color developing, bleach-fixing or bleaching and fixing, and stabilizing or washing steps.

In recent years, reduction of replenishers in the above-mentioned processing steps has been proposed in accordance with movement for reducing pollution, and technologies for reduced replenishing of color developer including that in Japanese Patent Publication Open to Public Inspection (hereinafter, referred to as Japanese Patent O.P.I Publication) No. 211750/1989 have been disclosed. However, fluctuation of photographic characteristics accompanied with the reduction of replenisher has become a serious problem The above-mentioned problem appears remarkably in continuous processing or running processing by means of an automatic processor.

A color light-sensitive material has a blue sensitive, a green sensitive and a red sensitive silver halide emulsion layers. These layers contain respectively a yellow coupler, a magenta coupler and a cyan coupler.

It has proved that a green sensitive silver halide emulsion containing a magenta coupler is easy to be affected by the fluctuation of photographic properties created in continuous processing in automatic processor, though the reason is unknown. Therefore, its improvement has been desired.

In addition, when a light-sensitive material is conveyed in an automatic processor, a problem that said light-sensitive material clings to conveyance rollers and adheres on a conveyance unit preventing normal conveyance and, in worse cases, stopping the conveyance, hereinafter, such a problem may be called "jamming problem", occurs in continuous processing especially, though it is a rare case. When a jamming problem occurs, not only loss in a light-sensitive material but also damages including time loss and labor loss expensed for abolishing it and stop of the automatic processor are extremely serious. Therefore, it is strongly demanded to eliminate the above-mentioned problem completely.

In addition, a so-called finished print photograph which has finished development processing has a problem peculiar to print photograph such as the adherence of finger-print like dirt when it contacts a hand and sticking of print photograph together. One of those which influence the above-mentioned problem is a feeling f sticking, or sticking property. Though causal relation between the above-mentioned feeling of sticking of print photograph and the occurrence of jamming problem is unknown, it is expectable that a jamming problem will be reduced when a feeling of sticking is eliminated.

In order to improve feeling of sticking in print photograph, a technology to employ fluid paraffin was disclosed in Japanese Patent O.P.I. Publication No. 267640/1989, a technology to employ a hydrophobic fluorine compound was disclosed in Japanese Patent O.P.I. Publication No. 96649/1989 and a technology to employ fine grained inorganic compound was disclosed in Japanese Patent O.P.I. Publication No. 206746/1988. However, since most of the above-mentioned materials were contained in the outermost layer in order to obtain higher effectiveness, all of them had a defect to be easy to create some deterioration in image. In addition, a feeling of sticking in print photograph proved to have a tendency to increase accompanied with continuation of processing.

SUMMARY OF THE INVENTION

Accordingly, the object of the present invention is to provide a silver halide photographic light-sensitive material excellent in image quality and surface characteristics, and is extremely less in the deterioration of photographic property and surface characteristics even when it is subjected to continuous processing and suitable for print use.

The above object of the invention can be achieved by a silver halide color photographic light-sensitive material comprising a support having thereon a photographic layer including a silver halide emulsion layer comprising silver halide grains, a binder and a compound represented by the following formula I, a non-light-sensitive layer being adjacent to said silver halide emulsion layer on its side closer to the support, and comprising a binder and a compound of the following Formula II being a liquid at 15° C., and a layer provided at the outermost position of the photographic layer comprising a binder and a compound represented by Formula II;

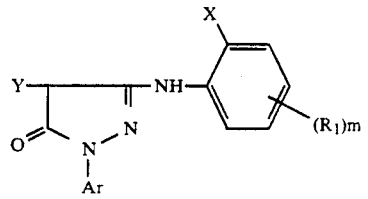

(I)

wherein Ar is an aryl group; X is a halogen atom, an alkoxyl group, or an alkyl group; Y is a hydrogen atom or a substituent capable of releasing upon reaction with the oxidation product of a color developing agent; and $R_1$ is a substituent: m is an integer of 1 to 4, a plurality of groups represented by $R_1$ may be the same or different when m is 2 or more and at least one of group represented by $R_1$ is a group represented by the following Formula Ia;

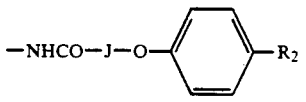

(Ia)

wherein J is a straight or branched chin alkyl group; $R_2$ is a strait or branched chain alkyl group having 1 to 20 carbon atoms;

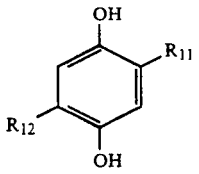

(II)

wherein $R_{11}$ and $R_{12}$ are each a secondary or tertiary alkyl group and a number of carbon atoms contained in the groups represented by $R_{11}$ and $R_{12}$ is 20 or more in total.

DETAILED DESCRIPTION OF THE INVENTION

In the present invention, at least one kind of compound represented by the above-mentioned Formula I is contained in at least one of light-sensitive layers containing a light-sensitive silver halide emulsion.

In Formula I, an aryl group represented by Ar is preferably a phenyl group having a substituent.

As preferable substituents, a halogen atom such as a fluorine atom, a chlorine atom and a bromine atom, an alkyl group such as a methyl group, an ethyl group and a butyl group, an alkoxy group such as a methoxy group and an ethoxy group, an aryloxy group such as a phenoxy group and a naphthoxy group, an acylamino group such as a α-(2,4-di-t-amylphenoxy)butylamido group and a benzoamido group, a sulfonylamino group such as a hexadecanesulfonamido group and a benzenesulfoneamido group, a sulfamoyl group such as a methylsulfamoyl group and a phenylsulfamoyl group, a carbamoyl group such as a butylcarbamoyl group and a phenylcarbamoyl group, a sulfonyl group such as a methylsulfonyl group, a dodecylsulfonyl group and a benzenesulfonyl group, an acyloxy group, an alkoxycarbonyl group, a carboxyl group, a sulfo group, a cyano group and a nitro group are cited.

X represents a halogen atom such as a chlorine atom, a bromine atom and a fluorine atom, an alkoxy group such as a methoxy group, an ethoxy group and a buthoxy group, and an alkyl group such as a methyl group, an ethyl group, an i-propyl group, a butyl group and a hexyl group.

As a group represented by Y capable of releasing upon the reaction of oxidation product of a color developing agent, for example, a halogen atoms such as a chlorine atom, a bromine atom and a fluorine atom, an alkoxy group, an aryloxy group, a heterocyclic oxy group, an acyloxy group, a sulfonyloxy group, an alkoxycarbonyloxy group, an aryloxycarbonyl group, an alkyloxalyloxy group, an alkoxyoxalyloxy group an alkylthio group, an arylthio group, a heterocyclic thio group, an alkyloxythio group, a carbonylthio group, an acylamino group, a sulfonamido group, a nitrogen-containing heterocycle bounding to the coupler residue with a nitrogen atom thereof, an alkyloxycarbonylamino group and an aryloxycarbonylamino group are cited.

Though there is no limitation in a group represented by $R_1$ capable of substituting with a benzene ring, at least one of them is preferable to be a substituent represented by the following Formula Ia.

Formula Ia

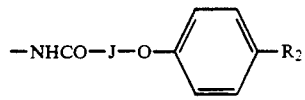

wherein $R_2$ represents a straight or branched chain alkyl group having 1 to 20 carbon atoms.

As the above-mentioned alkyl group, for example, a methyl group, a t-butyl group, a t-amyl group, a t-octyl group, a nonyl group and a dodecyl group are cited.

J represents a straight or a branched chain alkylene group, preferably a methylene group which may have an alkyl substituent or a trimethylene group which may have an alkyl substituent, more preferably a methylene group and most preferably a methylene group substituted with an alkyl having 1 to 20 carbon atoms such as a hexyl-methylene group, an octyl-methylene group and a dodecyl-methylene group. The most preferable is a methylene group having an alkyl substituent having 1 to 4 carbon atoms such as a methyl-methylene group, an ethyl-methylene group, an i-propyl-methylene group and a butyl-methylene group.

The following are practical examples of compounds represented by Formula I.

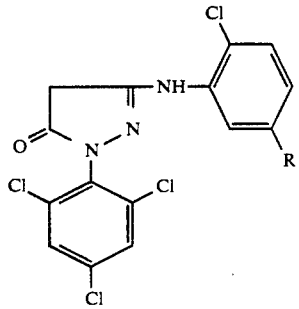

| No. | R |
|---|---|
| M-1 | 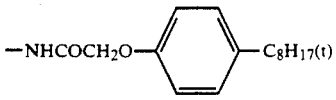 |

-continued
M-2
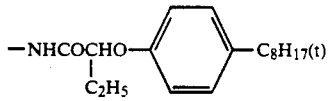
M-3
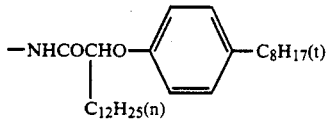
M-4
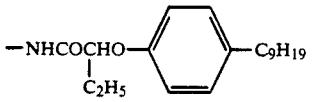
M-5
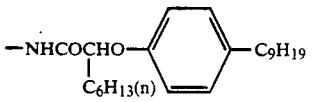
M-6
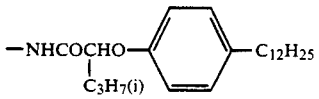
M-7
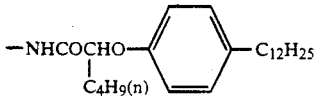
M-8
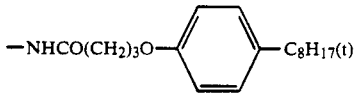
M-9
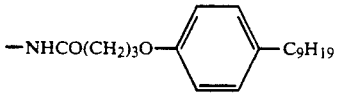
M-10
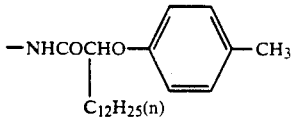
M-11
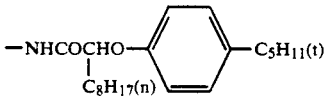
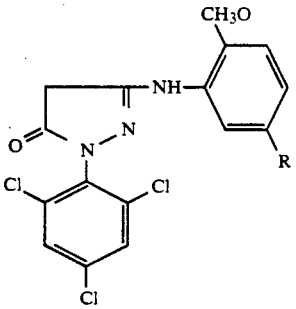
| No. | R |
|---|---|

-continued
M-12
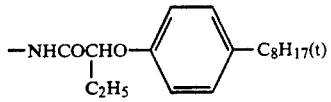
M-13
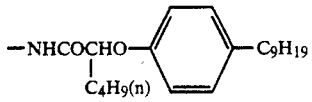
M-14
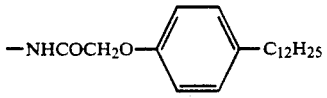
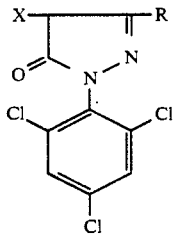
| No. | X | R |
|---|---|---|
| M-15 | H— | 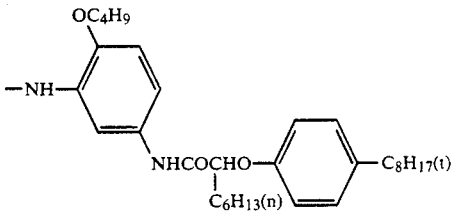 |
| M-16 | 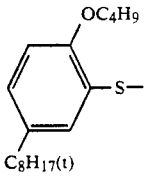 | 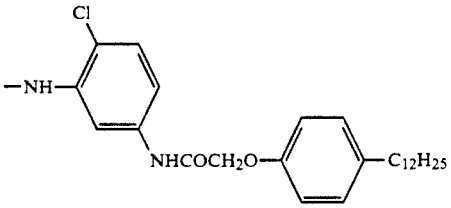 |
| M-17 | H— | 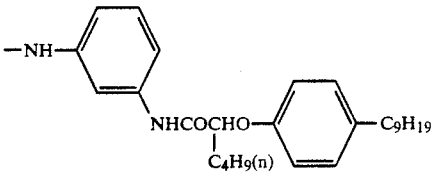 |
| M-18 | 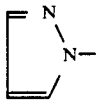 | 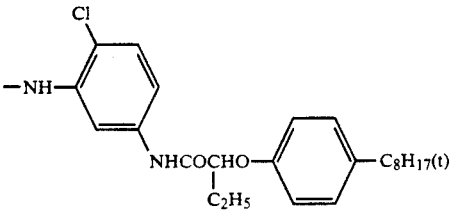 |

-continued
| | | |
|---|---|---|
| M-19 | H— | 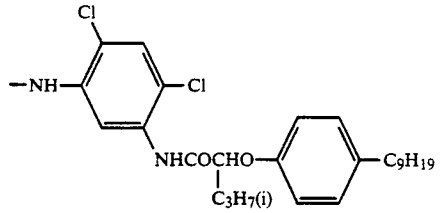 |
| M-20 | 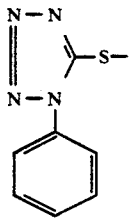 | 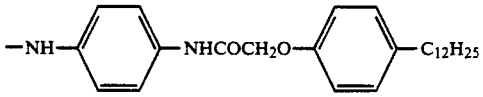 |
| M-21 | 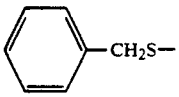 | 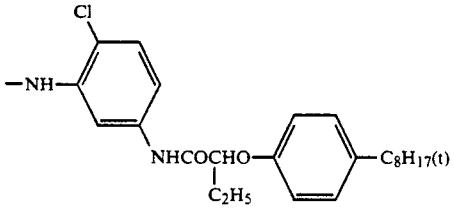 |
| M-22 | $CF_3CONH$— | 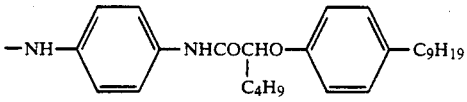 |
| M-23 | 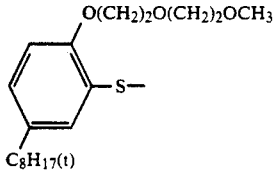 | 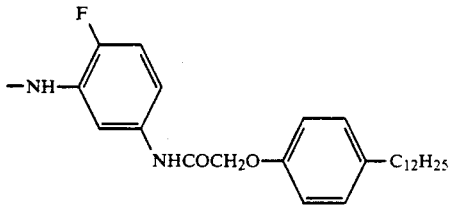 |
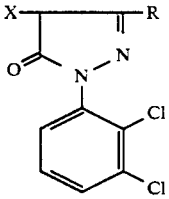
| No. | X | R |
|---|---|---|
| M-24 | H— | 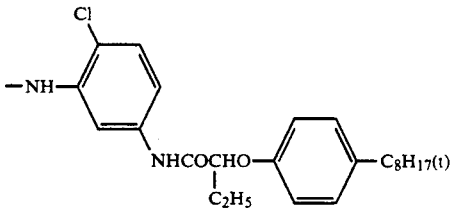 |
| M-25 | 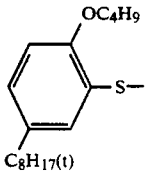 | 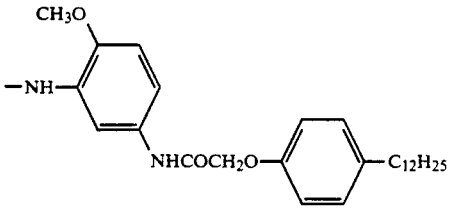 |

-continued
M-26
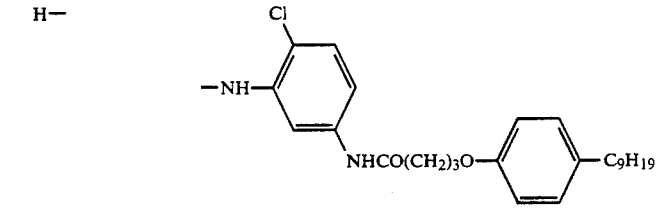
M-27
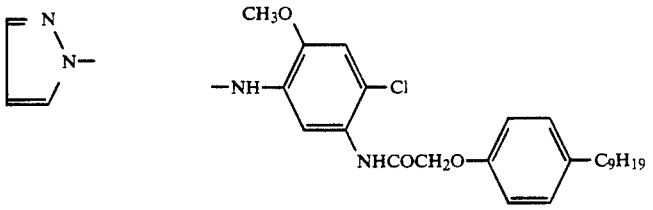
M-28
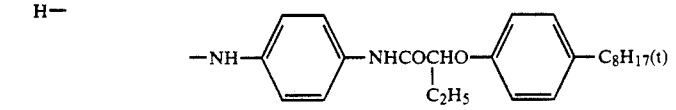
M-29
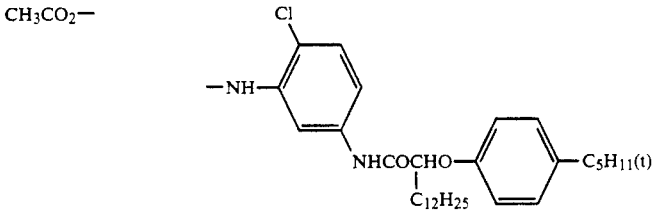
M-30
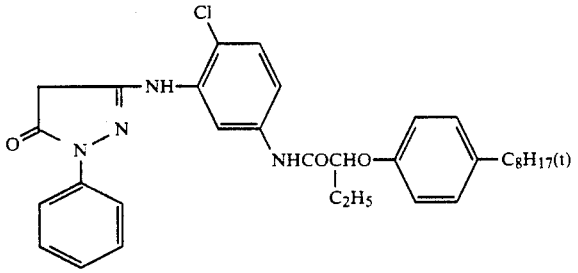
M-31
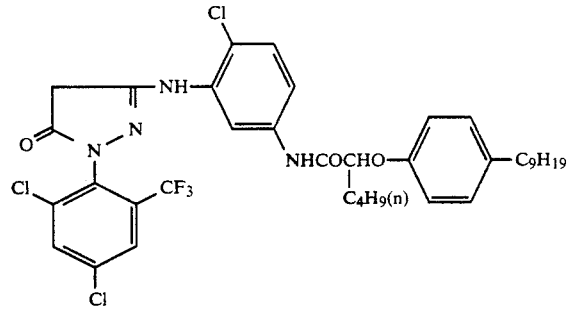
M-32
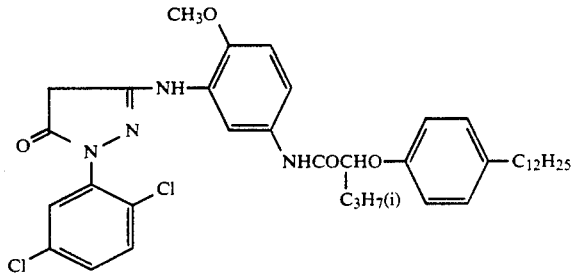

-continued

M-33

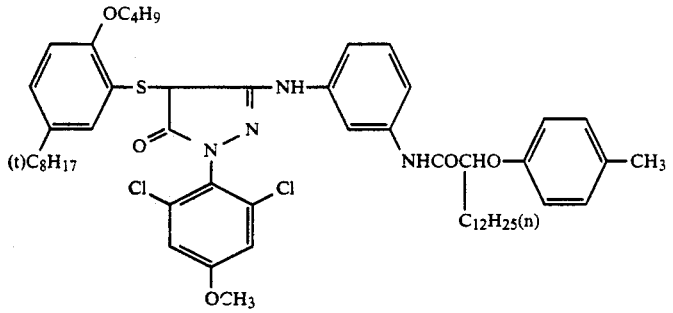

M-34

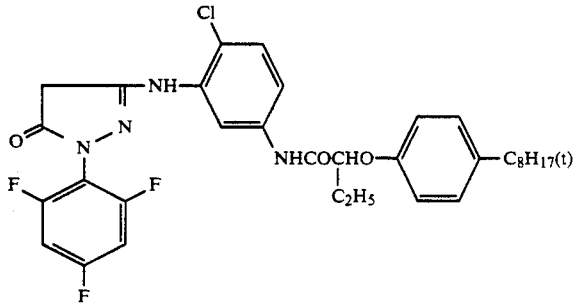

Examples of compounds represented by Formula I are other than the above M-1 to M-34 are described in Japanese Patent O.P.I. Publication No. 95551/1991, described in U.S. Pat. Nos. 2,600,788, 3,061,432, 3,062,653, 3,127,269, 3,311,476, 3,152,896, 3,419,391, 3,519,429, 3,555,318, 3,684,514, 3,888,680, 3,907,571, 3,928,044, 3,930,861, 3,930,866 and 3,933,500, Japanese Patent O.P.I. Publication Nos. 29639/1974, 11631/1974, 129538/1974, 13041/1975, 58922/1977, 62454/1980, 18034/1980, 38043/1981, 35858/1982, 2953/1985, 23855/1985 and 60644/1985 and British Patent No. 1,247,493, Belgium Patent Nos. 789,116 and 792,525, Germany Patent No. 2,156,111 and Japanese Patent Exined Publication Nos. 60479/1971 and 6577/1982.

In the present invention, at least one kind of compound represented by the above-mentioned formula II is contained in the outermost layer constituting the light-sensitive material.

Hereunder, we will explain the compound represented by Formula II.

As a secondary or a tertiary alkyl group represented by $R_{11}$ and $R_{12}$, for example, a sec-decyl group, a sec-dodecyl group and a t-dodecyl group can be Cited.

Compounds represented by Formula II are dialkylhydroquinones. Typical examples thereof are illustrated as follows.

In addition, quinone products of the compounds represented by Formula II can be employed.

As a adding method for the above-mentioned quinone products, a method to generate them naturally by means of air-oxidation of the compound represented by Formula II may be allowed and a method to add a quinone product synthesized separately may also be allowed.

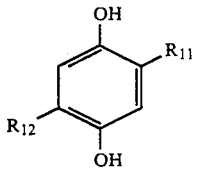

| No. | $R_{11}$ | $R_{12}$ |
|---|---|---|
| II-1 | $-C_{10}H_{21}$ (sec) | $-C_{10}H_{21}$ (sec) |
| II-2 | $-C_{12}H_{25}$ (sec) | $-C_{12}H_{25}$ (sec) |
| II-3 | $-C_{14}H_{29}$ (sec) | $-C_{14}H_{29}$ (sec) |
| II-4 | $-C_{16}H_{33}$ (sec) | $-C_{16}H_{33}$ (sec) |
| II-5 | $-C_{20}H_{41}$ (sec) | $-C_{20}H_{41}$ (sec) |
| II-6 | $-C_{30}H_{61}$ (sec) | $-C_{30}H_{61}$ (sec) |
| II-7 | $-C_{18}H_{37}$ (t) | $-C_{18}H_{37}$ (t) |
| II-8 | $-C_{15}H_{31}$ (sec) | $-C_{15}H_{31}$ (sec) |
| II-9 | $-C_{10}H_{21}$ (t) | $-C_{10}H_{21}$ (t) |
| II-10 | $-C_{12}H_{25}$ (t) | $-C_{12}H_{25}$ (t) |
| II-11 | $-C_{14}H_{29}$ (t) | $-C_{14}H_{29}$ (t) |
| II-12 | Reaction product of a mixture of α-orefins having 12 to 14 carbon atoms and hydroquinone | |
| II-13 | Reaction product of a mixture of α-orefins having 14 to 16 carbon atoms and hydroquinone | |
| II-14 | Reaction product of a mixture of α-orefins having 16 to 18 carbon atoms and hydroquinone | |

Compounds represented by Formula II are contained in the outermost layer constituting the light-sensitive material. It is preferable to be contained in an amount of 0.01 to 0.05 g/m$^2$ normally.

In addition, at least one kind of a color mixture preventing agent which is liquid at 15 ° C. is contained in at least one of light-sensitive layer and/or nonsensitive layers.

Hereunder, we will explain a color mixture preventing agent which is liquid at 15 ° C.

"Liquid" in the present specification defines a word of "One of aggregate condition of materials. Though it has a certain volume, it does not have a fixed shape." as mentioned in Rikagaku Jiten, (Dictionary of physies and chemical) published by Iwanami Shoten.

"A color mixture preventing agent" is common in the industry. The color mixture preventing agent which is liquid at 15 ° C. corresponds to a compound represented by the above-mentioned Formula II.

While the color mixture preventing agent which is liquid at 15 ° C. can be added in either of light-sensitive layers, it is preferable to be added to a nonsensitive layer adjacent to a silver halide emulsion layer containing a magenta coupler of Formula I and it is more preferable to be added to a nonsensitive layer adjacent to the emulsion layer on its side closer to the support.

The above-mentioned compounds are preferable to be added in an amount of 0.01 to 0.5 g/m$^2$ per one layer.

In the present invention, it is preferable to contain at least one kind of compound represented by the following Formula AS in the outermost layer constituting the light-sensitive material.

Formula AS

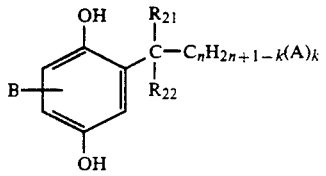

wherein $R_{21}$ and $R_{22}$ represent an alkyl group having 1 to 5 carbons respectively; n represents 1 to 20 integers; k represents 1 or 2;

A represents —(C=O)—L—$R_{23}$ (L represents —O— or —N($R_{24}$)—, $R_{23}$ represents a hydrogen atom, an alkyl group, an alkenyl group, a cycloalkyl group or an aryl group and $R_{24}$ represents a hydrogen atom, an alkyl group or an aryl group), —OV (V represents $R_{23}$ or —(C=O)—$R_{23}$ and $R_{23}$ is the same as mentioned above), —N($R_{24}$) ($R_{25}$) ($R_{24}$ is the same as mentioned above, $R_{25}$ represents a hydrogen atom, an alkyl group, an aryl group or —(C=O)—$R_{23}$ and $R_{23}$ is the same as mentioned above), —P($OR_{23}$) (=O) (O)q—$R_{26}$ (q represents 0 or 1, $R_{23}$ is the same as mentioned above and $R_{26}$ represents a hydrogen atom, an alkyl group, a cycloalkyl group, an alkenyl group or an aryl group) or a cyano group;

B represents an alkyl group, an alkenyl group, a cycloalkyl group, an aryl group, a heterocycle or a group represented by —C($R_{21}$) ($R_{22}$)—$C_nH_{2n+1}$—(A)k;

As alkyl groups having carbons 1 to 5 represented by $R_{21}$ and $R_{22}$, for example, a methyl group, an ethyl group, a propyl group, an i-propyl group, a butyl group, an s-butyl group, a pentyl group and a neopentyl group are cited; n represents 1 to 20 integers, and preferably 2 to 15;

Among each group constituting A, an Alkyl group, an alkenyl group, a cycloalkyl group and an aryl group represented by $R_{23}$, an alkyl group and an aryl group represented by $R_{24}$, an alkyl group and an aryl group represented by $R_{25}$ and an alkyl group, a cycloalkyl group, an alkenyl group and an aryl group represented by $R_{26}$ and, in addition, an alkyl group, an alkenyl group, a cycloalkyl group, an aryl group and a heterocycle represented by B include those having a substituent respectively; as substituents of the above-mentioned alkyl groups, for example, a halogen atom, a cycloalkyl group, an alkenyl group, an aryl group, an alkoxy group, an aryloxy group, an acyl group, a heterocycle and a cyano group are cited; as substituents for the above-mentioned alkenyl group, a cycloalkyl group, an aryl group and a heterocycle, for example, a halogen atom, an alkyl group, a cycloalkyl group, an alkenyl group, an aryl group, an alkoxy group, an aryloxy group, an acyl group, an heterocycle and a cyano group are cited;

As alkyl groups represented by $R_{23}$, $R_{24}$, $R_{26}$ and B, for example, a methyl group, an ethyl group, a propyl group, a butyl group, an s-butyl group, a hexyl group, a 2-ethyl-hexyl group, a dodecyl group, a hexadecyl group and a benzyl group are cited; as alkenyl groups represented by $R_{23}$, $R_{26}$ and B, for example, a cyclohexyl group is cited; as aryl groups represented by $R_{23}$, $R_{24}$, $R_{25}$, $R_{26}$ and B, for example, a phenyl group and a naphthyl group are cited.

In addition, compounds illustrated by the above-mentioned Formula AS is preferable to be compounds illustrated by the following Formula AS-II or their precursors.

Formula AS-II

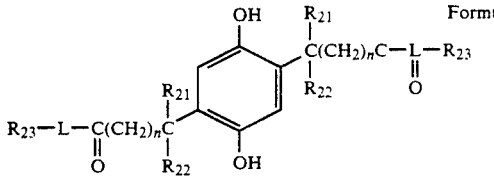

wherein $R_{21}$, $R_{22}$, $R_{23}$, L and n are the same as $R_{21}$, $R_{22}$, $R_{23}$, L and n in Formula AS.

Typical examples of compounds represented by Formula AS, H(1) to H(17), are as follows. However, the present invention is not limited thereto.

H(1)

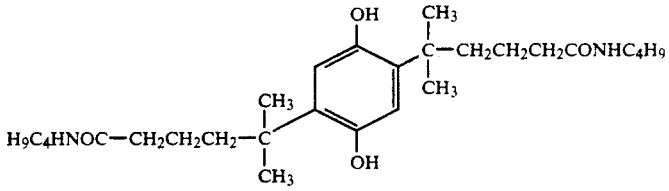

H(2)

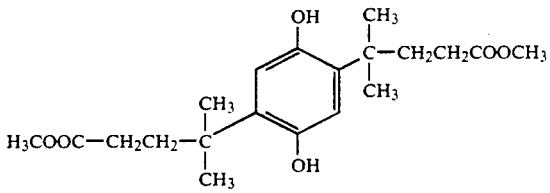

-continued
H(3)
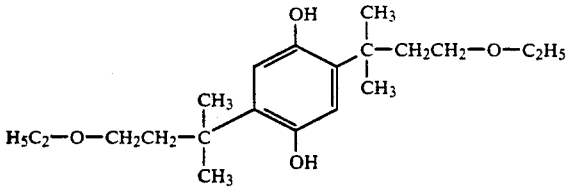
H(4)
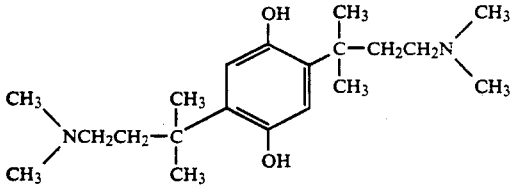
H(5)
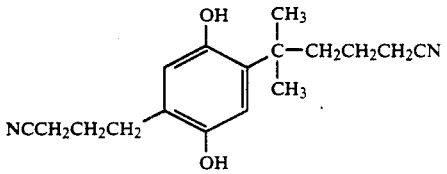
H(6)
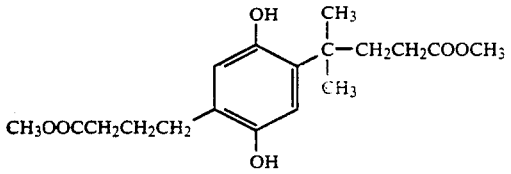
H(7)
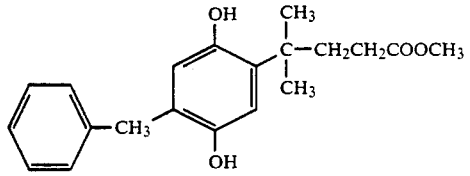
H(8)
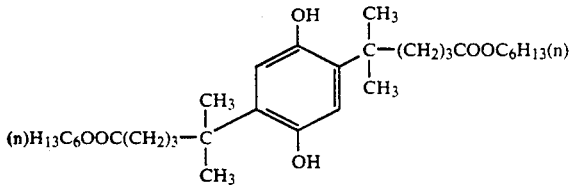
H(9)
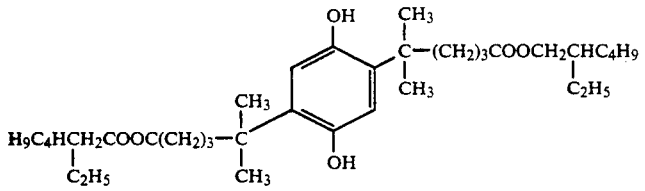
H(10)
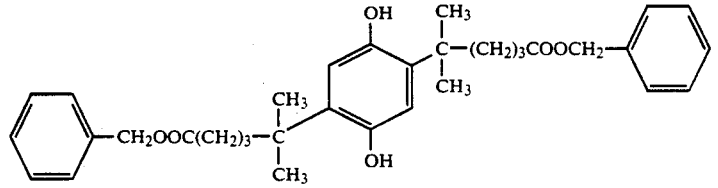

-continued

H(11)

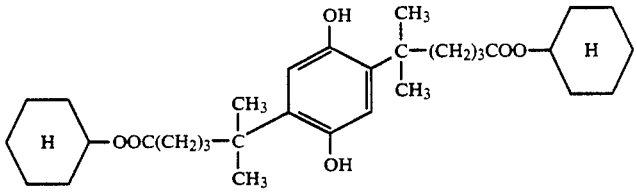

H(12)

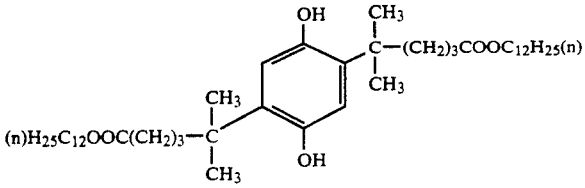

H(13)

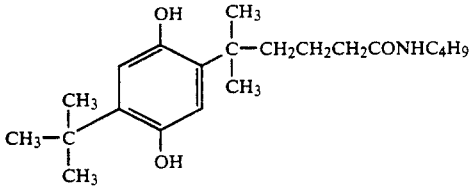

H(14)

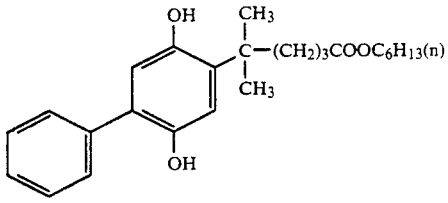

H(15)

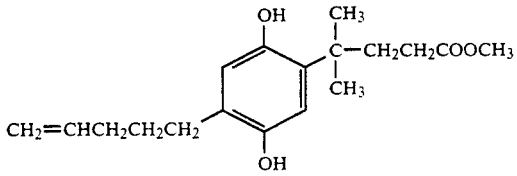

H(16)

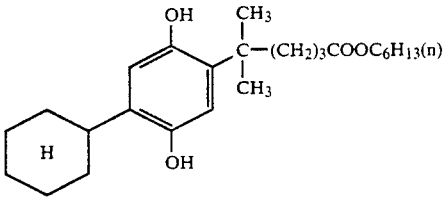

H(17)

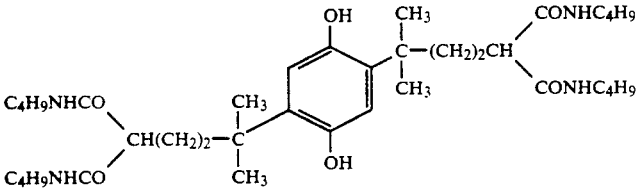

Compounds illustrated by Formula AS basically include compounds described in Japanese Patent O.P.I. Publication No. 24141/1983. The synthesis method described therein can be referred.

While it is preferable that the compounds represented by Formula AS is contained in the outermost layer constituting the light-sensitive material, it is preferable to be contained in an amount of 0.01 to 0.05 g/m$^2$ normally.

In the present invention, it is preferable that at least the light-sensitive material further has a silver halide emulsion layer containing a compound represented by the following Formula Y.

Formula Y

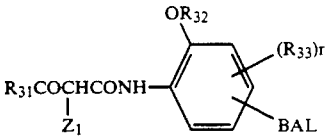

wherein $R_{31}$ represents an alkyl group, a cycloalkyl group or an aryl group; $R_{32}$ represents an alkyl group, a cycloalkyl group, an acyl group or an aryl group; $R_{33}$ represents a substituent; r represents 0 or 1; BAL represents a monovalent balast group; $Z_1$ represents a hydrogen atom or an atom or a group capable of releasing upon reaction with the oxidation product of a color developing agent.

With regard to substituents represented by $R_{31}$, $R_{32}$, $R_{33}$ and $Z_1$ in Formula Y, the same ones described in $R_1$, $R_2$, $R_3$ and Z in page 6 of Japanese Patent O.P.I. Publication No. 39958/1991 are cited. With regard to a mono balast group represented by BAL, those common in the industry are cited.

In addition, as practical examples of yellow couplers represented by Formula Y, Y-1-1 to Y-1-51 described on pp. 7 to 10 in the above-mentioned invention are cited. However, the present invention is not limited thereto.

The above-mentioned yellow dye forming coupler can be used in the range of $1\times10^{-3}-1$ mol and preferably in the range of $1\times10^{-2}$ to $8\times10^{-1}$ mol per mol of silver halide.

In the present invention, it is preferable to contain at that the light-sensitive material further has a silver halide emulsion layer containing a compound represented by the following Formulas C-I and C-II.

Formula C-I

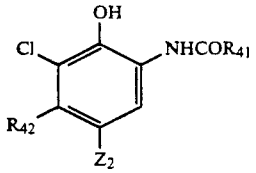

wherein $R_{41}$ represents a balast group; $R_{42}$ represents an alkyl group having 2 or more carbon atoms; Z represents a hydrogen atom or an atom or a group capable of releasing through the reaction with an oxidation product of color developer.

Formula C-II

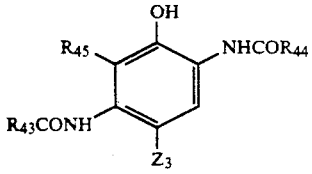

wherein $R_{43}$ represents an alkyl group or an aryl group; $R_{44}$ represents an alkyl group, a cycloalkyl group, an aryl group or a heterocycle; $R_{45}$ represents a hydrogen atom, a halogen atom, an alkyl group or an alkoxy group; $R_{45}$ may form a ring in cooperation with $R_{43}$; $Z_3$ represents a hydrogen atom or an atom or a group capable of releasing through the reaction with the oxidation product of color developer.

With regard to substituents represented by $R_{41}$, $R_{42}$ and $R_{43}$ in Formula C-1, those described in $R^4$, $R^5$ and $Z^2$ respectively rom the lower right column of page 5 to the upper left column of page 6 in Japanese Patent O.P.I. Publication No. 251845/1990 are cited.

I addition, as practical example of cyan couplers represented by Formula C-I, II-1 to II-20 described from the upper column at right on page 6 to the upper column at left on page 7 in the above-mentioned invention may be cited.

With regard to the substituents represented by $R_{43}$, $R_{44}$, $R_{45}$ and $Z_3$ in Formula C-II, the same groups as described in $R^1$, $R^2$, $R^3$ and $Z^1$ from the upper column at left to the lower column at left in Japanese Patent O.P.I. Publication No. 251845/1990 are cited.

In addition, as practical examples of cyan couplers represented by Formula C-II, I-1 to I-31 described on pp. 4 to 5 in the above-mentioned invention can be cited.

The cyan couplers represented by Formula C-1 are used in the range of $1\times10^{-3}$ to 1 mol normally and $1\times10^{-2}$ to $8\times10^{-10}$ mol preferably per mol of silver halide. In addition, the cyan couplers represented by Formula C-II are used in the range of $2\times10^{-3}$ to $8\times10^{-1}$ mol preferably and $1\times10^{-2}$ to $5\times10^{-1}$ mol especially preferably per mol of silver halide. Incidentally, it is preferable to employ C-I and C-II in combination because it offers superior color reproducibility.

The compounds such as dye forming couplers of the light-sensitive materials in the present invention are usually dissolved in a high boiling organic solvent having a boiling point of not lower than 150 ° C. and water-insoluble polymer and, if necessary, a low boiling and/or water-soluble organic solvent in combination. After the solution is emulsified and dispersed in a hydrophilic binder such as a gelatin aqueous solution by means of a surfactant, it is added to the aimed hydrophilic colloidal layer. It is allowed to insert a step to eliminate a low boiling organic solvent concurrently with dispersant or dispersing.

As a high boiling organic solvent, compounds having dielectric constant of not higher than 6.5 are preferable. For example, they are esters including phthalate and phosphate, organic acid amides, ketons and hydrocarbon compounds that have dielectric constant of not higher than 6.5. More preferably, high boiling organic solvents having a dielectric constant of 1.9 to 6.5 and the steam pressure at 100 ° C. is not higher than 0.5 mm Hg. Of them, the preferable are phthalate or phosphate, and the most preferable is a dialkylphthalate having an alkyl group having 9 or more carbon atoms. In addition, a high boiling organic solvent may be a mixture of 2 or more solvents.

Dielectric constant is defined to be one at 30 ° C.

The above-mentioned high boiling organic solvents are used at the rate of 0 to 400% by weight to the couplers normally and 10 to 100 weight % to the couplers preferably.

The photographic light-sensitive material of the present invention may be, for example, negative film for color photographic negative film, positive film and color paper. Of them, a color paper for direct appreciation use is offered superior effect by the present invention.

The light-sensitive materials in the present invention including the above-mentioned color paper may be a monocolor paper use and multicolor paper.

As a silver halide used for the light-sensitive materials in the present invention, any of those used for conventional silver halide emulsion including silver bromide, silver bromoiodide, silver iodochloride, silver bromochloride and silver chloride can be used.

The silver halide emulsions used in the present invention can be chemically sensitized by the sulfur sensitization method, the selenium sensitization method, the reduced sensitization method and the noble metal sensitization method. In addition, by the use of dyes known as sensitization dyes in the field of photographic industry, they can be optically sensitized to desired wavelength areas.

As a binder used for the light-sensitive materials in the present invention, it is preferable to use gelatin.

Gelatin used in the field of photographic industry usually includes alkali-processed gelatin processed with lime in the manufacturing process from cholagen and acid-processed gelatin processed with hydrochloric acid. The raw materials of gelatin are cattle bone, cattle hide and pig skin.

Acid treatment in acid-processed gelatin referred here is clearly distinguished from pH adjustment in the dispersant in the present invention.

Gelatin used in the light-sensitive materials in the present invention may be lime-processed gelatin and acid-processed gelatin. In addition, the raw material of gelatin may be any of cattle bone, cattle skin and pig skin. However, the preferable is lime-processed gelatin with cattle bone and pig skin as raw materials, and the further preferable for the uppermost layer is lime-processed gelatin with pig skin as the raw material.

The photographic emulsion layer and other hydrophilic colloidal layers in the light-sensitive material are hardened by employing a hardener independently or in combination which enhance the strength of layer by cross linking moleculs of binder or protective colloid.

UV absorbers may be contained in hydrophilic colloidal layers such as protective layers and intermediate layers in the present invention, in order to prevent fogging due to discharge caused by the frictional electrification and prevent deterioration of images due to UV rays.

Supplementary layers such as filter layers, anti-halation layer and/or anti-irradiation layers can be provided to the light-sensitive materials. In the above-mentioned layers and/or emulsion layers, dyes flowing out from the color light-sensitive material during development processing or being bleached may be contained.

Matting agents can be added to the silver halide emulsion layer and/or other hydrophilic colloidal layers in the light-sensitive material in order to reduce the luster of the light-sensitive material, enhance retouching property and prevent sticking of light-sensitive materials each other. In addition, lubricants can be added in order to reduce sliding friction.

An anti-static agent can be added to the light-sensitive material for the purpose of preventing static charge. An anti-static agent may be used in the anti-static layer provided on the side opposite to the support carrying emulsions and in protective colloidal layer other than emulsion layers on the side of support carrying emulsion layers.

Various surfactants are used in the photographic emulsion layers and/or other hydrophilic colloidal layers in the light-sensitive material for the purpose of improvement in coating property, preventing electric charge, improvement in sliding characteristic, emulsification and dispersion, preventing sticking and improvement in photographic characteristics including acceleration of development, hardening and sensitization.

In coating photographic light-sensitive material employing the silver halide emulsion in the present invention, a thickener may be employed in order to improve coating property. As a coating method, the extrusion coating method and the curtain coating method that can coat concurrently 2 or more layers are especially useful.

Color developing agent employed in the color developer in the present invention include conventional ones widely employed in various color photographic process.

In the present invention, the light-sensitive material may be processed with a processing solution having bleaching ability immediately after color developing. However, the processing solution having said bleaching capacity may be one having also fixing capacity so-called bleach-fixer. As a bleaching solution used in said bleaching process, metal complex salts of an organic acid are used.

EXAMPLE

Example 1

On a support laminated with polyethylene on one side thereof and polyethylene containing titanium oxide on the other side thereon, layers having compositions shown in Table 1 and Table 2 were coated on the side of polyethylene layer, and thereby samples of multi-layer silver halide color photographic light-sensitive material were prepared. The coating solutions were prepared in the following manner. Coating solution for first layer To 26.7 g of yellow coupler (Y-1), 10.0 g of dye image stabilizer (ST-1) and 6.67 g of dye image stabilizer (ST-2), 0.67 g of an additive (HQ-1) and 6.67 g of high boiling organic solvent (DNP), 60 ml of ethyl acetate was added to be dissolved. The solution thus obtained was emulsified and dispersed in 220 ml of 10% gelatin aqueous solution containing 7 ml of 20% surfactant (SU-1) by a supersonic homogenizer to prepare a yellow coupler dispersant. The above-mentioned dispersion was mixed with a blue sensitive silver halide emulsion, containing 10 g of silver, prepared under the following conditions to prepare First layer coating solution.

Second layer coating solution to Seventh layer coating solution were each prepared in a procedure similar to that in the above-mentioned First layer coating solution.

In addition, as hardeners, (H-1) was added in Second layer and Fourth layer and (H-2) was added in Seventh layer. As coating assistants, Surfactants (SU-2) and (SU-3) were added to prepare surface tension.

| Layer | Constitution | Amount added ($g/m^2$) |
|---|---|---|
| Seventh Layer (Protective layer) | Gelatin | 1.00 |
| | Compound (HQ-2) | 0.002 |
| | Compound (HQ-3) | 0.002 |
| | Compound (HQ-4) | 0.004 |
| | Compound (HQ-5) | 0.02 |
| | DIDP | 0.005 |
| | Compound (F-1) | 0.002 |
| Sixth layer (UV absorbing layer) | Gelatin | 0.40 |
| | UV absorber (UV-1) | 0.10 |
| | UV absorber (UV-2) | 0.04 |
| | UV absorber (UV-3) | 0.16 |
| | Compound (HQ-5) | 0.04 |
| | DNP | 0.20 |
| | PVP | 0.03 |
| | Anti-irradiation dye (AI-2) | 0.02 |
| | Anti-irradiation dye (AI-4) | 0.01 |
| Fifth layer (Red sensitive layer) | Gelatin | 1.30 |
| | Red sensitive silver bromide emulsion (Em-R) | 0.21 |
| | Cyan coupler (C-1) | 0.17 |
| | Cyan coupler (C-2) | 0.25 |
| | Dye image stabilizer (ST-1) | 0.20 |
| | Compound (HQ-1) | 0.01 |
| | HBS-1 | 0.20 |
| | DOP | 0.20 |
| Fourth layer (UV absorber | Gelatin | 0.94 |
| | UV absorber (UV-1) | 0.28 |

-continued

| Layer | Constitution | Amount added ($g/m^2$) |
|---|---|---|
| layer) | UV absorber (UV-2) | 0.09 |
| | UV absorber (UV-3) | 0.38 |
| | Compound (HQ-5) | 0.10 |
| | DNP | 0.40 |
| Third layer (Green sensitive layer) | Gelatin | 1.40 |
| | Green sensitive silver chloride emulsion (Em-G) | 0.22 |
| | Magenta coupler (M-1) | 0.35 |
| | Dye image stabilizer (ST-3) | 0.20 |
| | Dye image stabilizer (ST-4) | 0.17 |
| | DIDP | 0.13 |
| | DBP | 0.13 |
| | Anti-irradiation dye (AI-1) | 0.01 |
| Second layer (Intermediate layer) | Gelatin | 1.20 |
| | Compound (HQ-2) | 0.03 |
| | Compound (HQ-3) | 0.03 |
| | Compound (HQ-4) | 0.05 |

-continued

| Layer | Constitution | Amount added ($g/m^2$) |
|---|---|---|
| | Compound (HQ-5) | 0.23 |
| | DIDP | 0.06 |
| | Compound (F-1) | 0.002 |
| First layer (Blue sensitive layer) | Gelatin | 1.20 |
| | Blue sensitive silver chloro-bromide emulsion (Em-B) | 0.26 |
| | Yellow coupler (Y-1) | 0.80 |
| | Dye image stabilizer (ST-1) | 0.30 |
| | Dye image stabilizer (ST-2) | 0.20 |
| | Compound (HQ-1) | 0.02 |
| | Anti-irradiation agent (AI-3) | 0.01 |
| | DNP | 0.20 |
| Support | Polyethylene laminated paper | |

Added amounts of silver halide emulsion are illustrated in conversion of silver.

Y-1

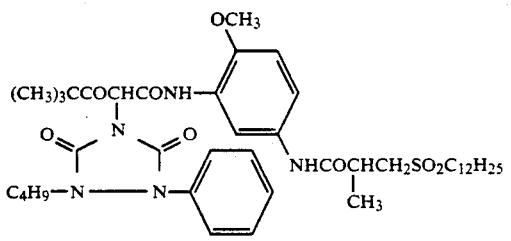

M-1

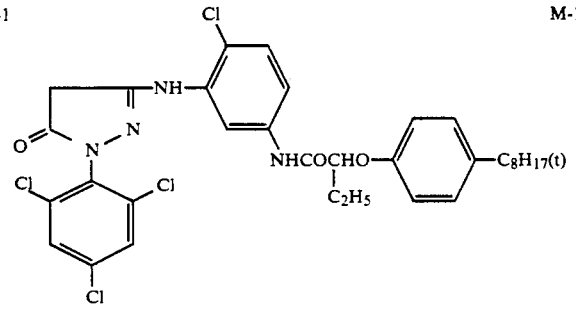

C-1

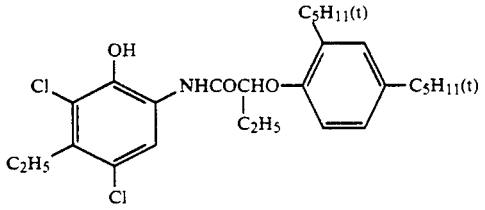

C-2

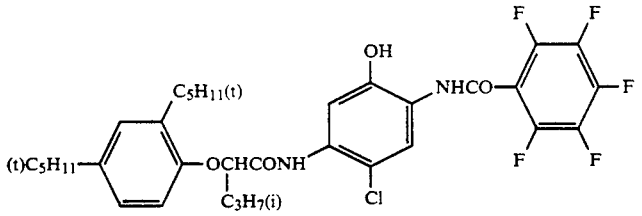

ST-1

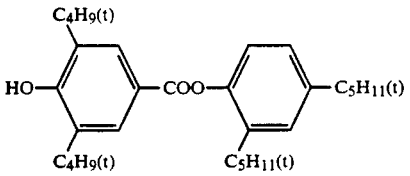

ST-2

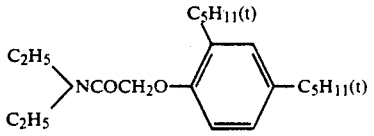

ST-3

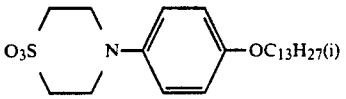

ST-4

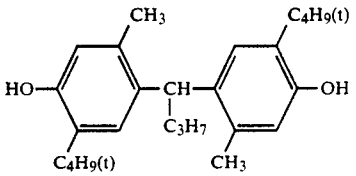

-continued
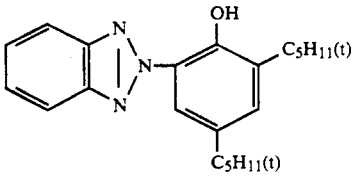
UV-1
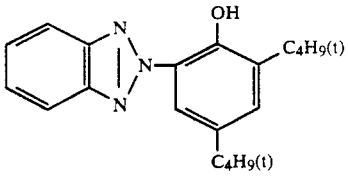
UV-2
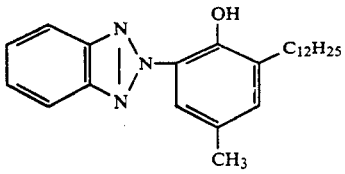
UV-3
DBP: Dibutylphthalate
DOP: Dioctylphthalate
DNP: Dinonylphthalate
DIDP: Diisodecylphthalate
PVP: Polyvinylpyrolidone
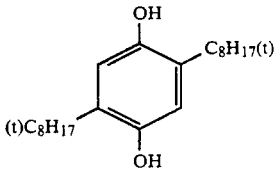
HQ-1
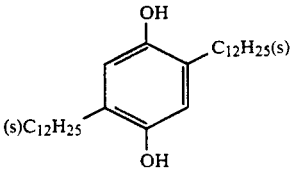
HQ-2
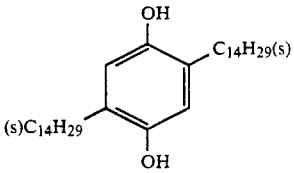
HQ-3
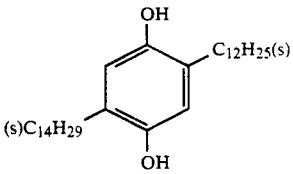
HQ-4
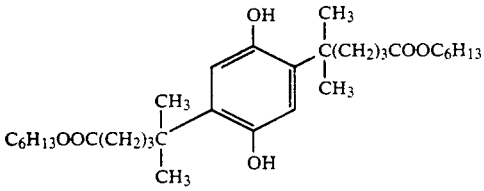
HQ-5
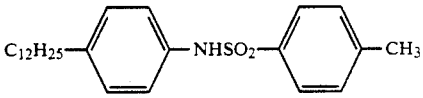
HBS-1
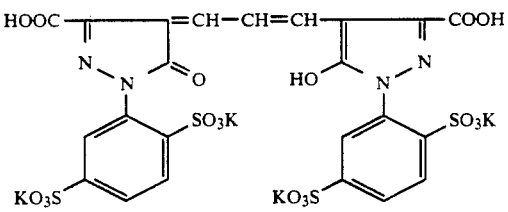
AI-1
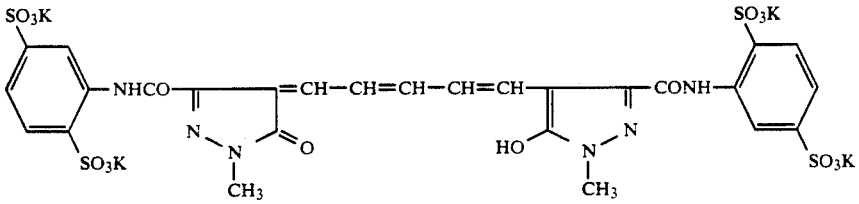
AI-2
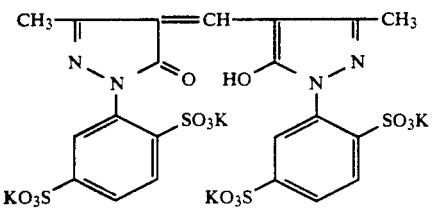
AI-3
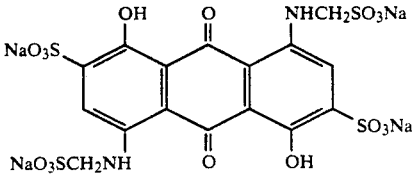
AI-4

-continued

SU-1

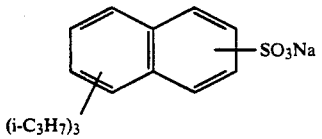

SU-2

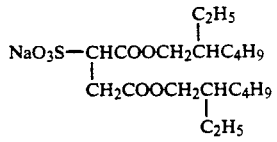

SU-3

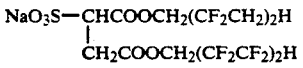

H-1

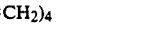

H-2

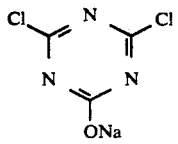

F-1

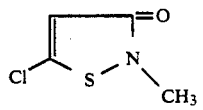

Preparation of a Blue Sensitive Silver Halide Emulsion

To 1,000 ml of 2% gelatin aqueous solution kept at 40° C., the below-mentioned Solution A and Solution B were added simultaneously for 30 minutes while pAg was controlled to 6.5 and pH was controlled to 3.0, and, in addition, the below-mentioned Solution C and Solution D were added simultaneously for 180 minutes while pAg was controlled to 7.3 and pH was controlled to 5.5. pAg was controlled by a method described in Japanese Patent O.P.I. Publication No. 45437/1984. pH was controlled employing sulfuric acid or sodium hydroxide aqueous solution.

| | |
|---|---|
| (Solution A) | |
| Sodium chloride | 3.42 g |
| Potassium bromide | 0.03 g |
| Add water to make 200 ml | |
| (Solution B) | |
| Silver nitrate | 10 g |
| Add water to make 200 ml | |
| (Solution C) | |
| Sodium chloride | 102.7 g |
| Potassium bromide | 1.0 g |
| Add water to make 600 ml | |
| (Solution D) | |
| Silver nitrate | 300 g |
| Add water to make 600 ml | |

After the finish of adding, desalting was conducted employing 5% aqueous solution of Demol N produced by Kao Atlas Co., Ltd and 20% aqueous solution of magnesium sulfate. Then, the solution was prepared with gelatin aqueous solution to prepare a mono-dispersed cubic grain emulsion EMP-1 having an average grain size of 0.85 μm, variation coefficient (standard deviation of grain size distribution/average gram size) of 0.07 and silver chloride content ratio of 99.5 mol %.

The above-mentioned emulsion EMP-1 was subjected to chemical ripening for 90 seconds at 50 ° C. employing the following compounds to prepare a blue sensitive silver halide emulsion Em-B.

| | |
|---|---|
| Sodium thiosulfate | 0.8 mg/mol AgX |
| Chloroauric acid | 0.5 mg/mol AgX |

-continued

| | |
|---|---|
| Stabilizer STAB-1 | $6 \times 10^{-4}$ mol/mol AgX |
| Stabilizer STAB-2 | $3 \times 10^{-4}$ mol/mol AgX |
| Sensitizing dye BS-1 | $6 \times 10^{-4}$ mol/mol AgX |
| Sensitizing dye BS-2 | $3 \times 10^{-4}$ mol/mol AgX |

Preparation of a Green Sensitive Silver Halide Emulsion

In the same manner as EMP-1 except that the adding time of Solution A and Solution B and the adding time of Solution C and Solution D, a mono-dispersed cubic grain emulsion EMP-2 having an average grain size of 0.43 μm, a variation coefficient of 0.08 and a silver chloride content ratio of 99.5 mol % was obtained.

EMP-2 was subjected to chemical ripening for 120 minutes at 55° C. employing the below-mentioned compounds to prepare a green sensitive silver halide emulsion Em-G.

| | |
|---|---|
| Sodium thiosulfate | 1.5 mg/mol AgX |
| Chloroauric acid | 1.0 mg/mol AgX |
| Stabilizer STAB-1 | $6 \times 10^{-4}$ mol/mol AgX |
| Stabilizer STAB-2 | $3 \times 10^{-4}$ mol/mol AgX |
| Sensitizing dye BS-1 | $4 \times 10^{-4}$ mol/mol AgX |

Preparation of a Red Sensitive Silver Halide Emulsion

In the same manner as EMP-1 except that the adding time of Solution A and Solution B and the adding time of Solution C and Solution D, a mono-dispersed cubic grain emulsion EMP-3 having an average grain size of 0.50 μm, a variation coefficient of 0.08 and a silver chloride content ratio of 99.5 mol % was obtained.

The above-mentioned emulsion EMP-3 was subjected to chemical ripening for 90 seconds at 60° C. employing the following compounds to prepare a blue sensitive silver halide emulsion Em-R.

| | |
|---|---|
| Sodium thiosulfate | 1.8 mg/mol AgX |
| Chloroauric acid | 2.0 mg/mol AgX |
| Stabilizer STAB-1 | $6 \times 10^{-4}$ mol/mol AgX |
| Stabilizer STAB-2 | $3 \times 10^{-4}$ mol/mol AgX |
| Sensitizing dye BS-1 | $1 \times 10^{-4}$ mol/mol AgX |

BS-1

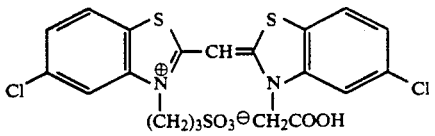

BS-2

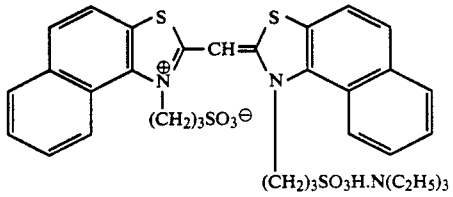

GS-1

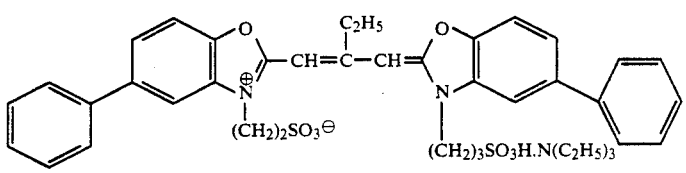

RS-1

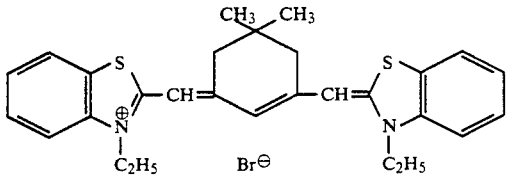

STAB-1

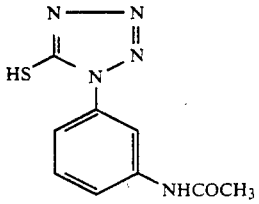

STAB-2

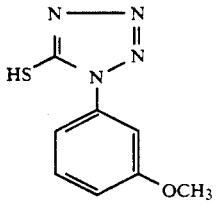

A color light-sensitive material thus obtained is defined to be No. 1.

Samples Nos. 2 to 15 were prepared in the same manner as Sample No.1 except that the yellow coupler, the magenta coupler, the cyan coupler and the compound of Formula II or AS and HQ-1 used in Sample No.1 were replaced as shown in Table 3.

The couplers used here are as follows:

TABLE 3

| Sample No. | Yellow coupler | Magenta coupler | Cyan coupler | | Compound of Formula II or AS: Second layer | Compound of Formula II or AS: Seventh layer |
|---|---|---|---|---|---|---|
| 1 (Invention) | Y-1 0.80 | M-1 0.35 | C-1 0.17 | C-2 0.25 | HQ-2,3,4 and 5 | HQ-2,3,4 and 5 |
| 2 (Invention) | Y-1 0.80 | M-1 0.35 | C-3 0.17 | C-2 0.25 | HQ-2,3,4 and 5 | HQ-2,3,4 and 5 |
| 3 (Invention) | Y-1 0.80 | M-1 0.35 | C-4 0.17 | C-2 0.25 | HQ-2,3,4 and 5 | HQ-2,3,4 and 5 |
| 4 (Invention) | Y-1 0.80 | M-5 0.35 | C-1 0.17 | C-2 0.25 | HQ-2,3,4 and 5 | HQ-2,3,4 and 5 |
| 5 (Invention) | Y-1 0.80 | M-6 0.35 | C-1 0.17 | C-2 0.25 | HQ-2,3,4 and 5 | HQ-2,3,4 and 5 |
| 6 (Invention) | Y-1 0.80 | M-1 0.35 | C-1 0.17 | C-2 0.25 | HQ-2,3 and 4 | HQ-2,3 and 4 |
| 7 (Invention) | Y-1 0.80 | M-1 0.35 | C-1 0.17 | C-2 0.25 | HQ-2,3 and 4 | HQ-2,3,4 and 5 |
| 8 (Comparative) | Y-1 0.80 | M-1 0.35 | C-1 0.17 | C-2 0.25 | HQ-1 | HQ-2,3,4 and 5 |
| 9 (Comparative) | Y-1 0.80 | M-1 0.35 | C-1 0.17 | C-2 0.25 | HQ-1 | HQ-1 |
| 10 (Comparative) | Y-1 0.80 | M-2 0.33 | C-1 0.17 | C-2 0.25 | HQ-2,3,4 and 5 | HQ-2,3,4 and 5 |
| 11 (Comparative) | Y-4 0.80 | M-1 0.35 | C-3 0.17 | C-2 0.25 | HQ-1 | HQ-1 |
| 12 (Comparative) | Y-2 0.80 | M-3 0.29 | C-3 0.15<br>C-5 0.03 | C-4 0.25 | HQ-1 | HQ-1 |
| 13 (Comparative) | Y-2 0.80 | M-4 0.29 | C-3 0.17 | C-4 0.25 | HQ-1 | HQ-1 |

TABLE 3-continued
| Sample No. | Yellow coupler | Magenta coupler | Cyan coupler | | Compound of Formula II or AS | |
|---|---|---|---|---|---|---|
| | | | | | Second layer | Seventh layer |
| 14 (Comparative) | Y-3 0.80 | M-5 0.35 | C-1 0.40 | — | HQ-1 | HQ-1 |
| 15 (Comparative) | Y-4 0.80 | M-6 0.35 | C-3 0.17 | C-2 0.25 | HQ-1 | HQ-1 |
HQ-1: Comparative hydroquinone derivative
Y-2
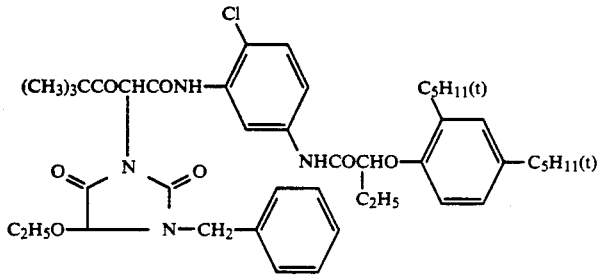
Y-3
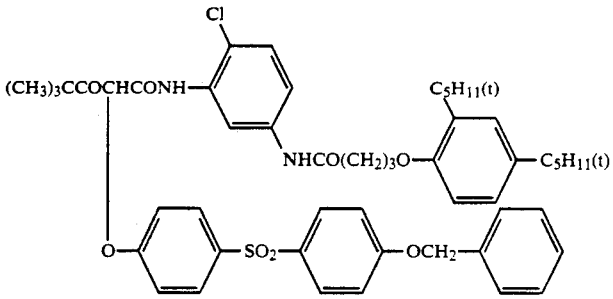
Y-4
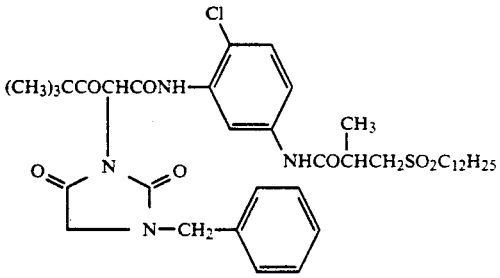
Y-5
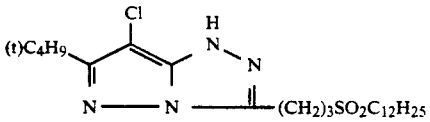
M-3
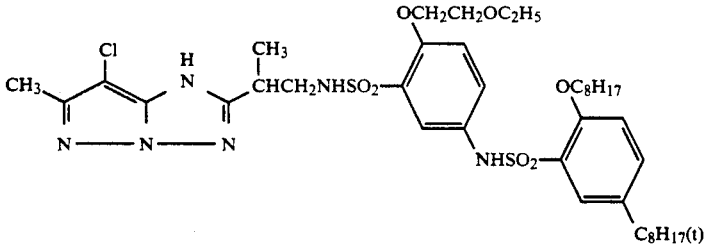
M-4
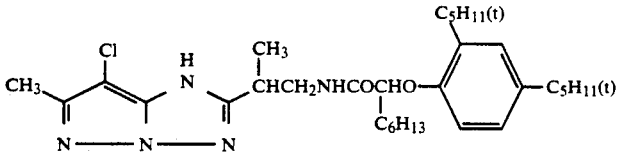

-continued

M-5

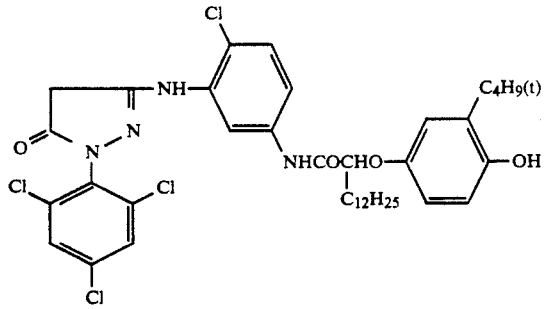

M-6

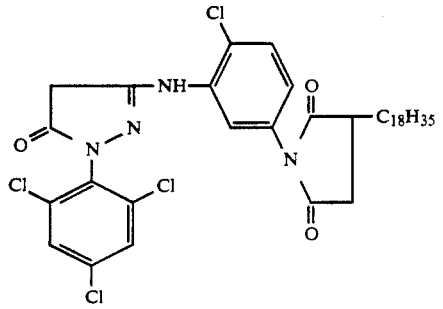

C-3

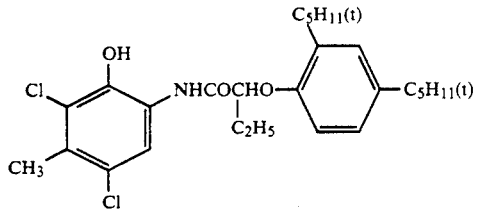

C-4

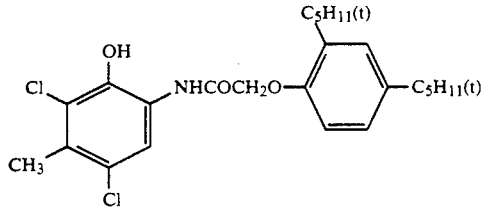

C-5

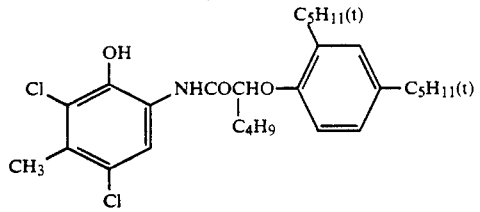

After the above-mentioned samples were exposed to light according to a conventional method, they were processed successively until the 3 times of the volume of the tank of color developer according to the following processing steps.

| Processing step | Temperature | Time |
|---|---|---|
| Color developing | 35 ± 0.3° C. | 45 sec. |
| Bleach fixing | 35 ± 0.5° C. | 45 sec. |
| Stabilizing | 30–34° C. | 90 sec. |
| Drying | 60–80° C. | 60 sec. |

| Color developer | |
|---|---|
| Pure water | 800 ml |
| Triethanolamine | 10 g |
| N,N-diethylhydroxylamine | 5 g |
| Potassium bromide | 0.02 g |

-continued

| | |
|---|---|
| Potassium chloride | 2 g |
| Potassium sulfite | 0.3 g |
| 1-hydroxyethylidene-1,1-disulfonic acid | 1.0 g |
| Ethylenediaminetetraacetatic acid | 1.0 g |
| Disodium catecol-3,5-disulfonate | 1.0 g |
| N-ethyl-β-methanesulfonamidoethyl-3-methyl-4-aminoaniline sulfate | 4.5 g |
| Brightening agent (4,4'-diaminostylbenzsulfonic acid derivative) | 1.0 g |
| Potassium carbonate | 27 g |

Add water to make 1,000 ml in total, and prepare pH to 10.10.

| Bleach-fixer | |
|---|---|
| Ferric ammonium ethylenediaminetetraacetate dihydate | 60 g |
| Ethylenediaminetetraacetatic acid | 3 g |
| Ammonium thiosulfate (70% aqueous solution) | 100 ml |
| Ammonium sulfite (40% aqueous solution) | 27.5 ml |

Add water to make 1,000 ml, and adjust pH to 5.7 with potassium carbonate or glacial acetatic acid.

| Stabilizer | |
|---|---|
| 5-chloro-2-methyl-4-isothiazoline-3-on | 1.0 g |
| Ethylene glycol | 1.0 g |
| 1-hydroxyethylidene-1,1-disulfonate | 2.0 g |
| Ethylenediaminetetraacetatic acid | 1.0 g |
| Ammonium hydroxide (20% aqueous solution) | 3.0 g |
| Brightening whitener (4,4'-diaminostylbenzsulfonic acid derivative) | 1.5 g |

Add water to make 1,000 ml in total, and prepare pH to 7.0 with sulfuric acid or potassium hydroxide.

Each of samples obtained through the above-mentioned processes was subjected to the following test on the evaluation of performance.

Change in Photographic Performance in Continuous Processing

The change was evaluated by the ratio of gradation between before and after or $\gamma$-value of the samples processed at the initial time and after continuous processing. The continuous processing was carried out under the following conditions. Rolls of color paper (12.7 cm×175 cm) were continuously given imagewise exposure and processed with a automatic printer processor NPS-602 QA manufactured by Konica Corporation. The processing was continued until the reprenishing amount of the developer replenisher reaches to that three times of the developing tank volume. In the course of the processing, 20 rolls of the light-sensitive material was processed. The $\gamma$-value was defined by a gradient a line conecting 2 points of the density on the characteristic curve, i.e., 0.80 and 1.80). The nearer the above-mentioned value becomes to 1, the fluctuation in successive performance becomes less and it indicates to be more excellent.

Change in gradation $=\gamma_R/\gamma_F$ $\gamma_R$: Gradation after continuous processing (run)

$\gamma_F$: Gradation before continuous processing (fresh)

Change on whiteness of background in continuous processing

The ratio of density in unexposed portion so-called white background whiteness of the samples processed at the initial time and after continuous processing was calculated. The nearer the above-mentioned value becomes to 1, the less the fluctuation in continuous processing is, and it indicates to be excellent.

Change in background whiteness $=\mathrm{Dmin}_R/\mathrm{Dmin}_F$ $\mathrm{Dmin}_R$: The density in unexposed portion after continuous processing (run)

$\mathrm{Dmin}_F$: The density in unexposed portion at the initial time of continuous processing (fresh)

Image Quality Change in Continuous Processing

With regard to image quality, we evaluated the image quality before and after continuous processing of the samples expose, developed and processed through the suitable standard negative film by means of 5-rank evaluation (1 to 5) through visual check in terms of whiteness and sharpness. 1 represents the smallest and 5 represents largest change in the image quality.

Surface Stickiness Change in Continuous Processing

The surface property of print photograph was evaluated as follows:

Print photographs before the continuous processing and after the continuous processing as above mentioned were sticked together respectively after the finish of drying. After they were left for 15 hours under the conditions of 40° C. and 80% RH, the resistance feeling of the print photograph sticking each other when they were peeled off was evaluated by means of 5-rank (1 to 5) evaluation. 1 represents the smallest and 5 represents the largest change in the stickiness.

1: Print photographs are completely separated.

3: There is a resistance to an extent that sound is hear when they are peeled off.

5: Print photographs cannot be peeled off. The results are shown in Table 4.

TABLE 4

| Sample No. | Change in gradation $\gamma_R/\gamma_F$ | Change in whiteness background $\mathrm{Dmin}_R/\mathrm{Dmin}_F$ | Change in image quality: Background whiteness | Change in image quality: Sharpness | Surface stickiness: Initial time of continuous processing | Surface stickiness: After continuous processing |
|---|---|---|---|---|---|---|
| 1 (Invention) | 0.99 | 1.01 | 1 | 1 | 1 | 1~2 |
| 2 (Invention) | 0.99 | 1.02 | 1 | 1 | 1 | 1~2 |
| 3 (Invention) | 0.98 | 1.03 | 1 | 1 | 1 | 1~2 |
| 4 (Invention) | 0.94 | 1.04 | 2 | 1 | 1 | 1~2 |
| 5 (Invention) | 0.91 | 1.08 | 2 | 1 | 1 | 1~2 |
| 6 (Invention) | 0.98 | 1.03 | 1 | 1 | 1 | 1~2 |
| 7 (Invention) | 0.98 | 1.01 | 1 | 1 | 1 | 1~2 |
| 8 (Comparative) | 0.98 | 1.02 | 1 | 1 | 2 | 3 |
| 9 (Comparative) | 0.98 | 1.02 | 1 | 1 | 3 | 3~4 |
| 10 (Comparative) | 1.10 | 1.10 | 2 | 2 | 2 | 2~3 |
| 11 (Comparative) | 1.15 | 1.18 | 3 | 2 | 3 | 4 |
| 12 (Comparative) | 0.84 | 1.03 | 1 | 2 | 1 | 1~2 |
| 13 (Comparative) | 0.86 | 1.03 | 1 | 2 | 1 | 1~2 |
| 14 (Comparative) | 0.97 | 1.14 | 3 | 2 | 4 | 4~5 |
| 15 (Comparative) | 1.17 | 1.19 | 3 | 3 | 3 | 4 |

As is apparent from Table 4, the stability on processing fluctuation was extremely deteriorated in Comparative samples. In addition, they were degraded in terms of image quality and surface property. However, all of the above-mentioned properties have been improved in the samples in the present invention.

The above-mentioned effects cannot be attained by each of independent technology. Of course, they were not attained b the sum of each technology. They are effects which cannot be expected by conventional technologies.

Example 2

Samples were prepared in the same manner as Example 1 except that the following 3 kinds were employed as a support.

| Kind of support | Contents of support | SRa value |
|---|---|---|
| PET-1 | A polyester film support containing 20 g of barium sulfate per 100 g of polyester (polyethyleneterephthalate) | 0.02 μm |
| PET-2 | A polyester film support containing 20 g of barium sulfate per 100 g of polyester (polyethyleneterephthalate) | 0.05 μm |
| PVD/PVCD | A vinyl chloride - vinyl vinylidene resin film support containing 20 g of barium sulfate per 100 g of vinyl chloride - vinylidene chloride copolymer resin | 0.04 μm |

SRa value represents roughness of the surface of support, as described in Japanese Patent O.P.I. Publication No. 173030/1989. The less the value is, the more the smoothness is. The measuring method of SRa is described in the above-mentioned application.

When the obtained samples were evaluated in the same manner as Example 1, the effect of the present invention was obtained.

Example 3

A support for photographic paper was prepared by the following method.

A bleach sulfite pulp was crushed at about 40 °SR, to which oil resin size having 2% weight to the pulp and starch size having 1% weight to the pulp were added. Then, a resin mixture solution composed of 1 part of vinylcyclohexendiepoxide and 7 art of stylene-unhydroxide maleic acid was added thereto by 1% of solid portion to pulp. Thus, the mixture was plowed in 150 g/m$^2$. In addition, gelatin was adhered thereon by 0.5 g/m$^2$ by means of tub size method.

On it, a solution wherein glossy baryta, matte baryta, gelatin, citric acid and chrome alum was mixed was coated so that the weight in drying would be 15 g/m$^2$. A support thus prepared is normally called a baryta base paper.

Samples were prepared in the same manner as Example 1 except that a baryta paper thus obtained was employed.

When the obtained sample was evaluated in the same manner as Example 1, the effect of the present invention was obtained.

What is claimed is:

1. A silver halide color photographic light-sensitive material comprising a support having thereon a photographic layer including a silver halide emulsion layer comprising silver halide grains, a binder and a compound of the following formula I, a non-light sensitive layer being adjacent to the said silver halide emulsion layer on its side closer to said support, which comprises a binder and a compound of the following Formula II being a liquid at 15° C., and a protective layer provided at the outermost position of said photographic layer, said protective layer containing a compound of the following Formula II;

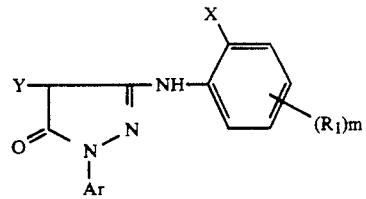

(I)

wherein Ar is an aryl group; X is a halogen atom, an alkoxyl group, or an alkyl group; Y is a hydrogen atom or a substituent capable of releasing upon reaction with the oxidation product of a color developing agent; and $R_1$ is a substituent; m is an integer of 1 to 4; a plurality of groups represented by $R_1$ may be the same or different when m is 2 or more and at least one of group represented by $R_1$ is a group represented by the following Formula Ia;

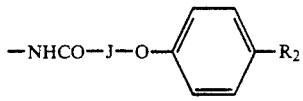

(Ia)

wherein J is a strait or branched chain alkyl group; and $R_2$ is a strait or branched chain alkyl group having 1 to 20 carbon atoms;

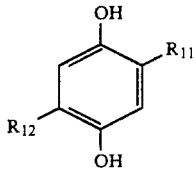

(II)

wherein $R_{11}$ and $R_{12}$ are each a secondary or tertiary alkyl group and a number of carbon atoms contained in said groups represented by $R_{11}$ and $R_{12}$ is 20 or more in total.

2. The light-sensitive material of claim 1, wherein said compound of Formula II is contained in said protective layer in an amount of 0.01 g/m$^2$ to 0.05 g/m$^2$.

3. The light-sensitive material of claim 1, wherein said compound of Formula II being a liquid at 15° C. is contained in said non-light-sensitive layer in an amount of 0.01 g/m$^2$ to 0.5 g/m$^2$.

4. The light-sensitive material of claim 1, wherein said protective layer further contains a compound of the following Formula AS;

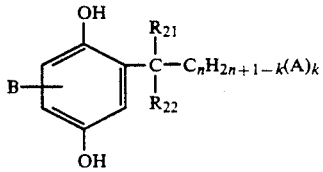

(AS)

wherein $R_{21}$ $R_{22}$ are each an alkyl group having 1 to 5 carbon atoms; n is an integer of 1 to 20; k is an integer of 1 or 2; A is —(C=)—L—$R_{23}$, —OV, —N($R_{24}$) ($R_{25}$), —P($OR_{23}$) (=O) $(O)_1$—$R_{26}$ or a cyano group, in which L is —O— or —N($R_{24}$)—, $R_{23}$ is a hydrogen atom, an alkyl group, an alkenyl group, a cycloalkyl group or an aryl group, $R_{24}$ is a hydrogen atom, an alkyl group or an aryl group, V is a group represented by $R_{23}$ or —(C=O)—L—$R_{23}$, $R_{25}$ is a hydrogen atom, an alkyl group or an aryl group or —(C=)=L—$R_{23}$, q is 0 or 1 and $R_{26}$ is a hydrogen atom, an alkyl group, a cycloalkyl group, an alkenyl group or an aryl group; B is an alkyl group, an alkenyl group, a cycloalkyl group, an aryl group, a heterocyclic group or a group represented by —C($R_{21}$) ($R_{22}$—$C_nH_{2n+1-k}$—$(A)_k$ in which $R_{21}$, $R_{22}$, n, k, and A the same as those defined as above.

5. The light-sensitive material of claim 4, wherein said compound of Formula AS is contained in said protective layer in an amount of 0.01 g/m$^2$ to 0.5 g/m$^2$.

6. The light-sensitive material of claim 4, wherein said compound of Formula AS is a compound of the following Formula AS-II:

(AS-II)

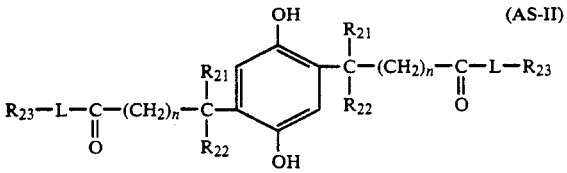

wherein $R_{21}$, $R_{22}$, $R_{23}$, L and n are the same as $R_{21}$, $R_{22}$, $R_{23}$, L and n defined in Formula AS.

7. The light-sensitive material of claim 1, wherein said light-sensitive material further has a silver halide emulsion layer containing a yellow coupler of the following Formula Y:

(Y)

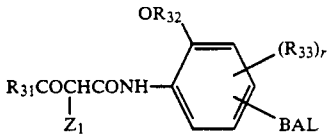

wherein $R_{31}$ is an alkyl group, a cycloalkyl group or an aryl group; $R_{32}$ is a an alkyl group, a cycloalkyl group, an acyl group or an aryl group; $R_{33}$ is a substituent; r is an integer of 0 or 1; BAL is a monovalent ballast group and $Z_1$ is a hydrogen atom or a substituent capable of releasing upon reaction with the oxidation product of a color developing agent.

8. The light-sensitive material of claim 1, wherein said light-sensitive material further as a silver halide emulsion layer containing a cyan coupler of the following Formula C-I or C-II;

(C-I)

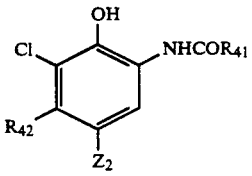

wherein $R_{41}$ is a ballast group; $R_{42}$ is an alkyl group having 2 or more carbon atoms; and $Z_2$ is a hydrogen atom or a substituent capable of releasing upon reaction with the oxidation product of a color developing agent, (C-II)

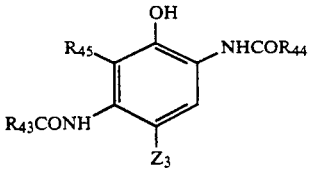

wherein $R_{43}$ is an alkyl group or an aryl group; $R_{44}$ is an alkyl group, a cycloalkyl group, an aryl group or a heterocyclic group; $R_{45}$ is a hydrogen atom, a halogen atom, an alkyl group, or an alkoxyl group, the group represented by $R_{45}$ may be linked with the group represented by $R_{43}$ to form a ring; and $Z_3$ is a hydrogen atom or a substituent capable of releasing upon reaction with the oxidation product of a color developing agent.

* * * * *